United States Patent [19]

Endo et al.

[11] 4,325,042

[45] Apr. 13, 1982

[54] THERMO-MAGNETICALLY OPERATED SWITCHES HAVING TWO DIFFERENT OPERATING TEMPERATURES

[75] Inventors: Masanori Endo, Yokohama; Kentaro Horiuchi, Sendai, both of Japan

[73] Assignee: Tohoku Metal Industries, Ltd., Sendai, Japan

[21] Appl. No.: 149,321

[22] Filed: May 13, 1980

[30] Foreign Application Priority Data

May 14, 1979 [JP] Japan ..... 54-57981

[51] Int. Cl.[3] ..... H01H 36/00

[52] U.S. Cl. ..... 335/208; 335/207

[58] Field of Search ..... 335/205, 206, 207, 208

[56] References Cited

U.S. PATENT DOCUMENTS

| | | | |
|---|---|---|---|
| 3,895,328 | 7/1975 | Kato et al. | 335/208 |
| 3,903,492 | 9/1975 | Endo et al. | 335/208 |
| 3,978,299 | 8/1976 | Takai | 335/208 |
| 4,023,128 | 5/1977 | Itou et al. | 335/208 |
| 4,121,184 | 10/1978 | Dinkler et al. | 335/208 X |

FOREIGN PATENT DOCUMENTS

| | | | |
|---|---|---|---|
| 2359581 | 7/1974 | Fed. Rep. of Germany | 335/208 |

*Primary Examiner*—George Harris

*Attorney, Agent, or Firm*—Posnack, Roberts, Cohen & Spiecens

[57] ABSTRACT

A thermo-magnetically operated switch having two different and predetermined lower and higher operating points on a temperature scale so that it may be maintained open below the lower operating point and above the higher operating point and be maintained closed between the two different operating points comprises two permanent magnets, and two kinds of temperature sensitive ferromagnetic members in proximity to a reed switch. The two permanent magnets are disposed over respective reeds of the reed switch in a similar polar direction and with an axial space therebetween. Two temperature sensitive ferromagnetic members having a higher Curie point are disposed at opposite outer sides of both permanent magnets or at opposite ends of the reed switch, and are in contact with respective permanent magnets. While one or more temperature sensitive ferromagnetic members having a lower Curie point are disposed within the axial space between the permanent magnets to magnetically connect the permanent magnets form at least one axial magnetic gap so that, even if the temperature is lower than the lower Curie point, leakage flux flows through the reeds of the reed switch. Thus, the switch is open below the lower Curie point and above the higher Curie point and is closed between the lower and higher Curie points.

4 Claims, 15 Drawing Figures

THERMO-MAGNETICALLY OPERATED SWITCHES HAVING TWO DIFFERENT OPERATING TEMPERATURES

BACKGROUND OF THE INVENTION

This invention relates to thermo-magnetically operated switches which utilize the saturation flux density versus the temperature characteristic of a magnetic substance to control the switching temperature, and in particular, to thermo-magnetically operated switches having two different operating points on a temperature axis.

A thermo-magnetically operated switch using magnetic materials which is constructed by positioning a permanent magnet and a magnetic substance in proximity to a reed switch whereby the contacts of the reed switch are opened and closed in response to changes in the temperature is known in the prior art as exemplified for example, by French Pat. No. 1,549,349, U.S. Pat. No. 3,295,081 and others.

Such thermo-magnetically operated switches as above mentioned are conveniently used to control the operation of devices operating in response to a predetermined temperature, because they are mechanically and thermally strong and solid, operatively stable in long use and, therefore, have a long life-time.

A typical known thermo-magnetically operated switch is of the one point operation type or of the type by which a switching operation is available at one point on a temperature axis. This restricts the fields of the use of thermo-magnetically operated switches of the known type.

We, the inventors of this invention, proposed thermo-magnetically operated switches having two different operating points, in U.S. Pat. No. 3,895,328 together with the other two joint inventors Mr. Kato and Mr. Satoh, wherein two permanent magnets and two kinds of magnetic members having different Curie points are assembled on the outer surface of a reed switch. One type of switch shown in U.S. Pat. No. 3,895,328 is one wherein it is open below a predetermined lower temperature and above a predetermined higher temperature and is closed between the lower and the higher temperatures. As this type, two arrangements are proposed, one of which is characterized by a thermo-magnetic element or a magnetic member disposed on the outer surface of a permanent magnet on the outer surface of the reed switch as shown in FIGS. 2A–8B of U. S. Pat. No. 3,895,328, the other being characterized by two permanent magnets and two kinds of magnetic members being axially arranged in cascade alongside the reed switch, as shown in FIGS. 9–11C of U.S. Pat. No. 3,895,328.

According to the former arrangement, the thermo-magnetically operated switch is relatively large-sized because two kinds of parts are superposed on one another on the outer surface of the reed switch. On the other hand, the switch according to the latter arrangement is relatively small-sized because all parts are arranged in cascade alongside the reed switch without any parts superposed on the other. But since similar magnetic poles of two permanent magnets confront one another, the magnets are apt to be demagnetized. This causes undesired variations of the operating points of the switch in the course of time.

In FIGS. 12A–12C of U.S. Pat. No. 3,895,328, a thermomagnetically operated switch is also shown wherein two permanent magnets are disposed so that different poles confront one another and wherein all magnetic parts are arranged in cascade alongside the reed switch. But the switch is not the type which is open below the lower temperature and above the higher temperature and is closed between the lower and the higher temperatures (an open-close-open type), but is of the type which is closed below the lower temperature and above the higher temperature and is open between the lower and the higher temperatures (a close-open-close type).

In certain fields of use of thermo-magnetically operated switches, not the close-open-close type but the open-close-open type is required.

SUMMARY OF THE INVENTION

It is, therefore, a general object of this invention to provide an improved thermo-magnetically operated switch of the type which is open below a predetermined lower temperature and above a predetermined higher temperature and closed between the lower and the higher temperatures (an open-close-open type).

It is a specific object of this invention to provide a thermo-magnetically operated switch of the open-close-open type which is small-sized, excellent in reliability and temperature response, and of long life.

It is another object of this invention to realize the above objects with a simple construction which is readily assembled.

According to this invention, a thermo-magnetically operated switch having two different, lower and higher, operating points on a temperature scale comprises an elongated reed switch having an envelope and a pair of ferromagnetic reeds hermetically sealed in the envelope with the free ends thereof overlapped for opening and closing movements relative to one another. Two first magnetic members which are formed of first ferromagnetic substances having a first Curie point corresponding to the higher operating point, are disposed alongside, and at axial opposite ends of, the reed switch, respectively, with an axial space therebetween. Two permanent magnets having Curie points higher than the operating temperature range of the switch are disposed alongside the reed switch within the axial space between the first magnetic members and in contact with the first magnetic member respectively, so that a pole of one of the permanent magnets is opposite a different magnetic pole of the other magnet with an axial space therebetween. The permanent magnets are disposed over the reeds, respectively, but short of the overlapped ends of the reeds. At least one magnetic member which is formed of second ferromagnetic substances having a second Curie point corresponding to the lower operating point, is disposed in the axial space between the permanent magnets with at least one axial magnetic gap. The at least one second magnetic member magnetically connects the confronting magnetic poles of the permanent magnets at a temperature lower than the second Curie point. The switch is open below the lower operating point and above the higher operating point and is closed between the lower and the higher operating points.

According to an aspect of this invention, the second magnetic member is disposed within the axial space between the opposite magnetic poles of the permanent magnets but apart from the opposite magnetic poles to maintain axial gaps at opposite ends thereof.

According to another aspect of this invention, the second magnetic member is disposed in contact with one of the permanent magnets but apart from the other permanent magnet to form an axial gap therebetween.

According to still another aspect of this invention, two second magnetic members are disposed within the axial space between the permanent magnets to be in contact with the permanent magnets respectively and disposed with an axial gap therebetween.

Further objects, features and other aspects of this invention will be understood from the following detailed description of preferred embodiments of this invention referring to the annexed drawings.

DETAILED DESCRIPTION OF PREFERRED EMBODIMENTS

Figure 1A:
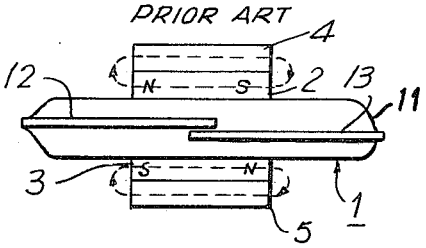
FIG. 1a PRIOR ART
FIGS. 1*a*–1*f* are diagrammatic sectional views of different arrangements of known thermo-magnetically operated switches having two operating temperatures.
Figure 1B:
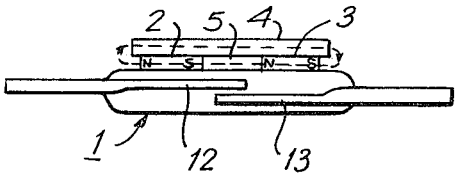
FIG. 1b PRIOR ART
Figure 1C:
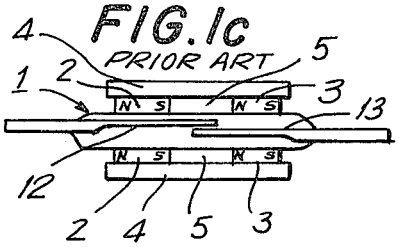
FIG. 1c PRIOR ART
Figure 1D:
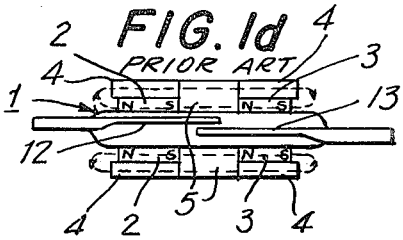
FIG. 1d PRIOR ART
Figure 1E:
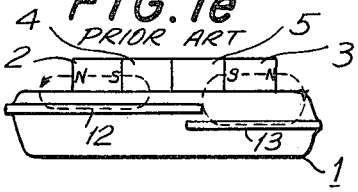
FIG. 1e PRIOR ART
Figure 1F:
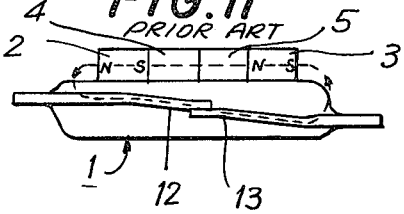
FIG. 1f PRIOR ART

Various known arrangements of thermo-magnetically operated switches of a type which has two different operating points on a temperature scale are shown in FIGS. 1*a*–1*f*. Each switch shown in the figures comprises a reed switch 1 having a glass envelope 11 and a pair of reeds 12 and 13, two permanent magnets 2 and 3, and two kinds of temperature sensitive magnetic members 4 and 5. The arrangements shown in FIGS. 1*a*–1*f* correspond to arrangements in the U.S. Pat. No. 3,895,328, that is, the switch of FIG. 1*a* corresponds to the switch of FIGS. 3A–3C of the U.S. patent, the switch of FIG. 1*b* corresponds to the switch of FIGS. 4A–4C of the U.S. patent, the switch of FIG. 1*c* corresponds to the switch of FIG. 5 of the U.S. patent, switch of FIG. 1*d* corresponds to the switch of FIG. 6 of the U.S. patent, the switch of FIG. 1*e* corresponds to the switch of FIGS. 11A–11C of the U.S. patent, and the switch of FIG. 1*f* corresponds to the switch of FIGS. 12A–12C of the U.S. patent. The description of the arrangements and the operation of the switches shown in FIGS. 1*a*–1*f* will be omitted for purposes of simplification of the specification because they are completely understood by reference to the U.S. patent.

Those switches shown in FIGS. 1*a*–1*f* have disadvantages as described hereinbefore.

This invention intends to provide a novel arrangement of permanent magnets and two kinds of magnetic members along, and in proximity with, the reed switch to remove those disadvantages in the known switches having two different operating temperatures.

Figure 2A:
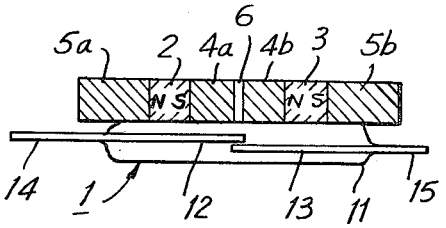
FIG. 2*a* is a cross-sectional view of an embodiment of this invention.

Referring to FIG. 2*a*, an embodiment of this invention comprises a reed switch 1, two permanent magnets 2 and 3, low and high temperature sensitive ferromagnetic members 4*a*, 4*b*, 5*a* and 5*b*.

The reed switch, as well known, comprises an elongated envelope 11, which is preferably made of glass, a pair of reeds 12 and 13 hermetically sealed therein, which are made of ferromagnetic and electroconductive materials with ends thereof being overlapped for undergoing opening and closing movements relative to one another, and lead wires 14 and 15 connected with respective reeds, sealed to opposite ends of the glass envelope 11 and outwardly extending therefrom.

The permanent magnets 2 and 3 have Curie points exceeding the operating temperature range of the switch and may be made of magnets selected from various known types of magnets.

The low temperature sensitive ferromagnetic members 4*a* and 4*b* each have a Curie point corresponding to a predetermined lower temperature within the operating temperature range of the switch, and the high temperature sensitive ferromagnetic members 5*a* and 5*b* have a Curie point corresponding to a predetermined higher temperature within the operating temperature range. These temperature sensitive ferromagnetic members 4*a*–5*b* are made of ferrite or other ferromagnetic material having a desired Curie point.

Permanent magnets 2 and 3 are mounted on and secured by adhesive to the outside of glass envelope 11 of reed switch 1 in such fashion that they are disposed in similar polar directions alongside reed switch 1 at different axial positions and in parallel with respective reeds 12 and 13, but short of not only the overlapped ends of the reeds but opposite ends of the reed switch.

Figure 2B:
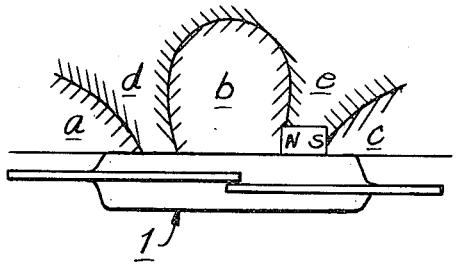
FIG. 2*b* is a view graphically illustrating the distribution of a region where a magnet is disposed to close the reed switch and the other region where a magnet is disposed to open the reed switch.

Generally speaking, when a permanent magnet is disposed in proximity to, and in parallel with, a reed switch, it is determined by the position at which the permanent magnet is disposed whether the reed switch is open or closed. A region in which the permanent magnet is disposed to make the reed switch (the region will be referred to by "contact closing zone") and the other region in which the permanent magnet is disposed to break the reed switch (the region will be referred to by "contact opening zone") are known by moving the permanent magnet in proximity of the reed switch, and the distribution of the contact closing zone and the contact opening zone is illustrated in FIG. 2*b*. In FIG. 2*b*, there are three contact closing zones a, b and c and two contact opening zones d and e. A similar distribution is disclosed in the U.S. Pat. No. 3,750,064, as a magnetic flux graph.

Permanent magnets 2 and 3 of the embodiment of FIG. 2*a* are disposed in contact opening zones d and e in FIG. 2*b*.

Low temperature sensitive ferromagnetic members 4*a* and 4*b* are disposed within an axial space between confronting and different magnetic poles of permanent magnets 2 and 3, and are arranged in an axial direction with an axial magnetic gap 6 therebetween. One low temperature sensitive ferromagnetic member 4*a* is in contact with one permanent magnet 2 and the other member 4*b* is in contact with the other magnet 3. The magnetic gap 6 is formed by free space or non-magnetic materials.

High temperature sensitive ferromagnetic members 5*a* and 5*b* are disposed at respective positions opposite low temperature sensitive ferromagnetic members 4*a* and 4*b* in relation to permanent magnets 2 and 3, and are in contact with permanent magnets 2 and 3, so that each magnet 2 and 3 is interposed between each pair of low and high temperature sensitive ferromagnetic members 4a–5a and 4b–5b. Therefore, it will be understood that high temperature ferromagnetic members 5a and 5b are disposed at different axial positions corresponding to opposite ends of reed switch 1.

Low and high temperature sensitive ferromagnetic members 4a–5b are also secured to reed switch 1 by an adhesive.

The operation of the thermo-magnetically operated switch of FIG. 2a will be described referring to FIGS. 3a–3c.

When the environment or observed object is at a temperature lower than a predetermined lower operating point corresponding to the Curie point of low temperature sensitive ferromagnetic members 4a and 4b, the contact of reed switch 1 is maintained open.

Figure 3A:
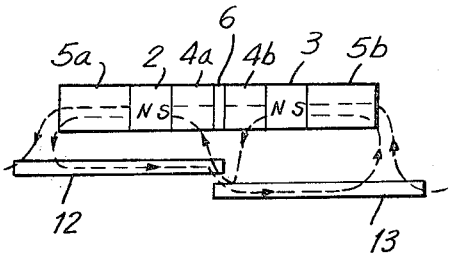
FIGS. 3*a*–3*c* are views for schematically explaining the operation of the switch in FIG. 2*a;*

Referring to FIG. 3a, at a temperature lower than the Curie point of low temperature sensitive ferromagnetic members 4a and 4b, both permanent magnets 2 and 3 are connected to one another by low temperature sensitive ferromagnetic members 4a and 4b so that the magnetic flux from one magnetic pole, or N-pole, of the confronting different magnetic poles of permanent magnets 2 and 3 flows to the other magnetic pole, or S-pole, through low temperature sensitive ferromagnetic members 4a and 4b. Therefore, permanent magnets 2 and 3, low temperature sensitive ferromagnetic members 4a and 4b and high temperature sensitive ferromagnetic members 5a and 5b are seen to be equivalent to an elongated permanent magnet, if magnetic gap 6 is ignored, and therefore, it is considered that there is magnetic flux $\phi_1$ flowing through both reeds 12 and 13 in series to close the overlapped ends of both reeds 12 and 13. But since magnetic gap 6 extends between both low temperature sensitive ferromagnetic members 4a and 4b, there is leakage flux $\phi_2$ which flows through the overlapped ends of both reeds 12 and 13, in a counter direction to the flux $\phi_1$. The magnetic flux $\phi_1$ is cancelled by the leakage flux $\phi_2$ at the overlapped ends of both reeds 12 and 13. As a result, the contact of reed switch 1 is maintained open.

When the temperature is elevated above the Curie point of low temperature sensitive ferromagnetic members 4a and 4b but lower than the Curie point of high temperature sensitive ferromagnetic members 5a and 5b, low temperature sensitive ferromagnetic members 4a and 4b turn paramagnetic or non-magnetic. This means that the magnetic gap 6 is widened so that the leakage flux $\phi_2$ is increased. Therefore, the leakage flux $\phi_2$ is not entirely cancelled by the magnetic flux $\phi_1$ so that the overlapped ends are closed, as shown in FIG. 3b.

When the temperature is further elevated above the Curie point of high temperature sensitive ferromagnetic members 5a and 5b, these members 5a and 5b also turn paramagnetic or non-magnetic. As a result, magnetic flux $\phi_1$ does not flow through high temperature sensitive ferromagnetic members 5a and 5b but flows directly between the permanent magnets and reeds. Accordingly, the magnetic resistance for the magnetic flux $\phi_1$ decreases so that the magnetic flux $\phi_1$ increases. Therefore, the leakage flux $\phi_2$ is again cancelled by the increased magnetic flux $\phi_1$ at the overlapped ends of the both reeds 12 and 13, so that the reed switch is open as shown in FIG. 3c.

Figure 4:
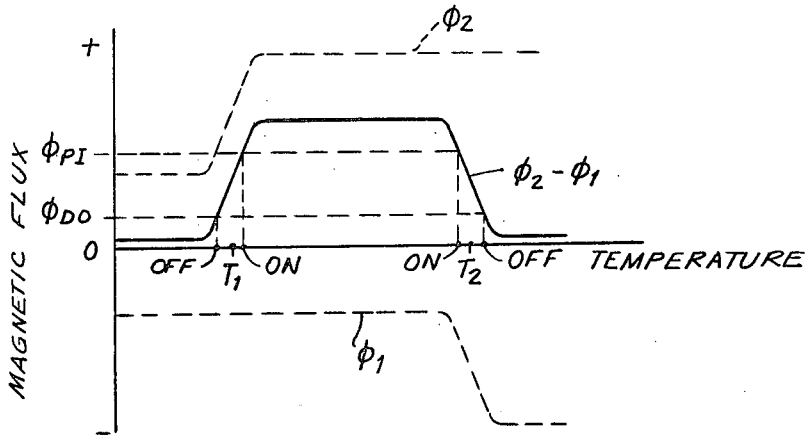
FIG. 4 is a view graphically illustrating the variation of magnetic fluxes $\phi_1$ and $\phi_2$ in response to variation of temperature.

The variation of magnetic fluxes $\phi_1$ and $\phi_2$ in response to various temperatures is illustrated in FIG. 4. In FIG. 4, $T_1$ and $T_2$ are the respective Curie points of low temperature sensitive ferromagnetic members 4a and 4b and high temperature sensitive ferromagnetic members 5a and 5b. It will be understood from a curve representing $(\phi_2-\phi_1)$ that the reed switch is closed between Curie points $T_1$ and $T_2$ and is open below the Curie point $T_1$ and above the Curie point $T_2$.

As well known in the prior art, the critical magnetic flux $\phi_{PI}$ to turn on a reed switch is different from, and larger than, the critical magnetic flux $\phi_{DO}$ to turn off the reed switch.

In view of this fact, in the thermo-magnetically operated switch, the temperature at which reed switch 1 turns on is different from the temperature at which reed switch turns off, near each Curie point of $T_1$ and $T_2$.

Figure 5:
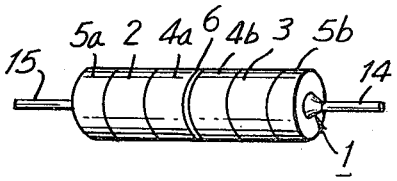
FIG. 5 is a perspective view of a modified switch according to the embodiment of FIG. 2*a;*

Permanent magnets 2 and 3, low temperature sensitive ferromagnetic members 4a and 4b and high temperature sensitive ferromagnetic members 5a and 5b may be in cylindrical forms, as shown in FIG. 5. The reed switch is fitted into and contained in those cylindrical parts.

Figure 6:
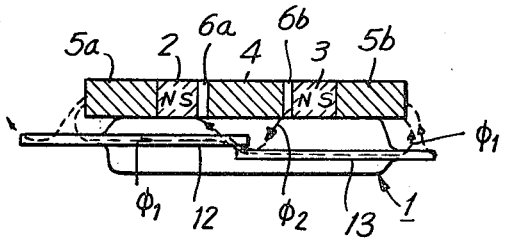
FIG. 6 is a cross-sectional view of another embodiment.

In another embodiment of this invention as shown in FIG. 6, a single piece low temperature sensitive ferromagnetic member 4 is used. The single member 4 is disposed within an axial space between the confronting different magnetic poles of permanent magnets 2 and 3. Low temperature sensitive ferromagnetic member 4 is spaced from both permanent magnets 2 and 3 to form opposite axial magnetic gaps 6a and 6b. The remainder of the arrangement is similar to that in the embodiment of FIG. 2a.

At a temperature lower than the Curie point of low temperature sensitive ferromagnetic member 4, permanent magnets 2 and 3, low temperature sensitive ferromagnetic member 4 and high temperature sensitive ferromagnetic members 5a and 5b are seen as an elongated permanent magnet if magnetic gaps 6a and 6b are ignored. Therefore, a magnetic flux $\phi_1$ is considered present which flows through both reeds in series to close the overlapped ends of the reeds. But, since axial gaps 6a and 6b exist between low temperature sensitive ferromagnetic member 4 and each of permanent magnets 2 and 3, there is a leakage flux $\phi_2$ which flows through both reeds in a counter direction of the magnetic flux $\phi_2$. Accordingly, magnetic flux $\phi_1$ and leakage flux $\phi_2$ are cancelled at the overlapped ends of reeds 12 and 13, so that the reed switch is open.

Figure 3B:
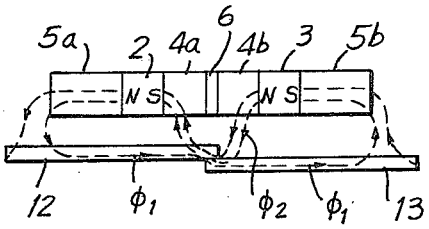
Figure 3C:
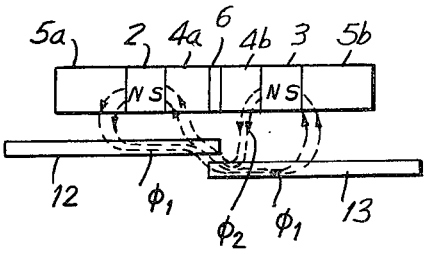

When the temperature is elevated above the Curie point of low temperature sensitive ferromagnetic member 4 and further elevated above the Curie point of high temperature sensitive ferromagnetic members 5a and 5b, and when temperature sensitive ferromagnetic members 4, 5a and 5b turn paramagnetic, respectively, it will be easily understood that the variations of magnetic flux $\phi_1$ and leakage flux $\phi_2$ are similar to those shown in FIGS. 3b and 3c.

Accordingly, the thermo-magnetically operated switch of FIG. 6 is open below the Curie point of low temperature sensitive ferromagnetic member 4 and above the Curie point of high temperature sensitive ferromagnetic members 5a and 5b, and is closed between the lower Curie point and the higher Curie points.

Figure 7:
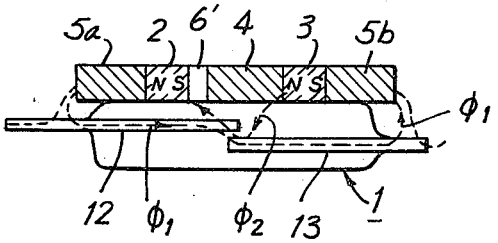
FIG. 7 is a cross-sectional view of still another embodiment.

In still another embodiment shown in FIG. 7, single piece of low temperature sensitive ferromagnetic member 4 is in contact with one of the permanent magnets (magnet 3) and spaced from the other (magnet 2) to form an axial magnetic gap 6'. The remainder of the arrangement is similar to the embodiments in FIGS. 2*a* and 6.

At a temperature lower than the Curie point of low temperature sensitive ferromagnetic member 4, the magnetic flux $\phi_1$ flowing through the overlapped ends of reeds 12 and 13 from an equivalent elongated magnet formed by permanent magnets 2 and 3, and low and high temperature sensitive ferromagnetic members 4, 5*a* and 5*b* is cancelled by the leakage flux $\phi_2$ due to the existence of magnetic gap 6', so that the reed switch is open.

Since low temperature sensitive ferromagnetic member 4 turns paramagnetic at a temperature above the Curie point of low temperature sensitive ferromagnetic member 4, the operation of the switch of this embodiment in the elevated temperature range is similar to that of the embodiment of FIG. 2*a* which is described in conjunction with FIGS. 3*b* and 3*c*.

In the arrangements shown in FIGS. 6 and 7, permanent magnets 2 and 3, low temperature sensitive ferromagnetic member 4 and high temperature sensitive ferromagnetic members 5*a* and 5*b* may be formed as cylindrical parts and fitted and assembled onto the reed switch, similar to the embodiment of FIG. 5.

What is claimed is:

1. A thermo-magnetically operated switch having two different and predetermined lower and higher operating points on a temperature scale so that it may be maintained open below the lower operating point and above the higher operating point and be maintained closed between the two different operating points, which comprises:

an elongated reed switch having an envelope and a pair of ferromagnetic reeds hermeticaly sealed in said envelope with free ends thereof overlapped for opening and closing movements relative to one another;

two first magnetic members formed of first ferromagnetic substances having a first Curie point corresponding to said higher operating point, said first magnetic members being disposed alongside, and at axial opposite ends of, said reed switch with an axial space therebetween;

two permanent magnets having a Curie point higher than an operating temperature range of the switch and disposed alongside said reed switch within said axial space between said first magnetic members and in contact with said first magnetic members respectively, so that a magnetic pole of one of said permanent magnets is opposite a different magnetic pole of the other permanent magnet with an axial space therebetween, respective permanent magnets being disposed over the respective reeds but spaced from the overlapped ends of the reeds; and at least one magnetic member of second ferromagnetic substance having a second Curie point corresponding to said lower operating point and disposed in said axial space between said permanent magnets with at least one axial magnetic gap.

2. The thermo-magnetically operated switch as claimed in claim 1, wherein two second magnetic members are disposed within said axial space between said permanent magnets and are in contact with said permanent magnets respectively and are disposed with an axial gap therebetween to form said at least one axial magnetic gap.

3. The thermo-magnetically operated switch as claimed in claim 1, wherein said second magnetic member is disposed within said axial space between said opposite magnetic poles of said permanent magnets but spaced from said opposite magnetic poles to maintain axial gaps at opposite ends thereof to form two said axial magnetic gaps.

4. The thermo-magnetically operated switch as claimed in claim 1, wherein said second magnetic member is disposed in contact with one of said permanent magnets but spaced from the other permanent magnet to maintain an axial gap therebetween to form said at least one axial magnetic gap.

* * * * *